US005403633A

United States Patent [19]

Jenisch

[11] Patent Number: 5,403,633

[45] Date of Patent: Apr. 4, 1995

[54] CONICAL STACKING TUBE BODY AND METHOD OF PRODUCING THE SAME

[75] Inventor: Michael Jenisch, Schopfheim, Germany

[73] Assignee: Christian Maer GmbH & Co., KG, Tübingen, Germany

[21] Appl. No.: 30,129

[22] PCT Filed: Jul. 15, 1992

[86] PCT No.: PCT/EP92/01606

§ 371 Date: Mar. 11, 1993

§ 102(e) Date: Mar. 11, 1993

[87] PCT Pub. No.: WO93/02008

PCT Pub. Date: Feb. 4, 1993

[30] Foreign Application Priority Data

Jul. 16, 1991 [DE] Germany ..... 9108727 U

[51] Int. Cl.[6] ..... B65H 75/18; B65H 75/50

[52] U.S. Cl. ..... 428/34.2; 428/36.9; 428/36.91; 428/36.92; 428/132; 428/133; 242/118.32; 242/118.3; 206/505; 206/519; 493/287; 493/296; 138/147; 138/177

[58] Field of Search ..... 428/34.2, 36.9, 36.91, 428/36.92, 132, 133; 242/118.32, 118.3, 118.31; 493/287, 296, 906, 153, 154, 155; 138/140, 144, 147, 148, 127; 206/515, 516, 517, 518, 519, 520, 505

[56] References Cited

U.S. PATENT DOCUMENTS

| | | | |
|---|---|---|---|
| 2,017,611 | 10/1935 | Stogner | 242/118.32 |
| 2,195,240 | 3/1940 | Chaplin et al. | 242/118.32 |
| 2,569,094 | 9/1951 | Dunlap | 242/118.32 |
| 2,615,650 | 10/1952 | Betner et al. | 242/118.32 |
| 3,463,352 | 8/1969 | Heister | 206/515 |
| 3,643,888 | 2/1972 | Blue | 242/118.32 |
| 3,675,871 | 7/1972 | Heyden | 242/118.3 |

FOREIGN PATENT DOCUMENTS

| | | |
|---|---|---|
| 0398599 | 11/1990 | European Pat. Off. . |
| 2425420 | 12/1975 | Germany . |
| 3643819 | 6/1988 | Germany . |
| 1211997 | 11/1970 | United Kingdom . |
| 3121022 | 12/1982 | United Kingdom . |
| 2100704 | 1/1983 | United Kingdom . |

*Primary Examiner*—Alexander S. Thomas
*Assistant Examiner*—Rena L. Dye
*Attorney, Agent, or Firm*—Michael J. Striker

[57] ABSTRACT

A conical hollow tube body of paper or another organic molding material is made by forming a conical hollow tube body member having a narrow end and a wide end, and producing a spacing formation by making at least one dimple on an inside in the area of the narrow end by forming a projection in a wall of the body member immediately upon completion of the body member from an outside of the latter.

10 Claims, 3 Drawing Sheets

CONICAL STACKING TUBE BODY AND METHOD OF PRODUCING THE SAME

BACKGROUND OF THE INVENTION

The invention refers to a conical, hollow, stacking tube body made of paper or of another organic moulded material, the inside of which, in the area of its inwardly tapering end, possesses at least one dimple serving to maintain a defined gap between the stacked tube bodies.

Conical stacking plastic products, for example plastic beakers, have been provided heretofore which contain moulded dimples to prevent the conical objects from being pushed too far into each other when nested, and so avoid an unwanted wedging effect. In tube bodies produced of paper, in particular those produced by winding from paper webs, it is not possible to form dimples for this purpose. Attempts have been made to create internal spacing means by embossing neps into a paper web which forms the inside of a wound tube body. However, this measure complicates the winding process and does not guarantee that the internal spacing means are formed in the correct position. In addition, the spacing means thus formed have proven to be of insufficient strength, as they can be easily squashed on contact with the bottom wall of a nested tube body. Automation of spooling frames with automatic removal of bobbin tubes which are made of paper or another organic moulded material from a bobbin stack, however, requires measures which prevent wedging of the nested conical tube bodies.

SUMMARY OF THE INVENTION

Accordingly, it is an object of the present invention to provide a conical stacking tube body and a method of producing the same, which avoids the disadvantages of the prior art.

More particularly, it is an object of the present invention to provide a method of producing a conical stacking tube body, and a hollow tube body, which is made of paper or another organic molding material and which is capable of being stacked, in such a way as to securely prevent wedging of the tube body in the tube stack.

The aforementioned object is achieved using the initially described tube body according to the present invention by the provision of an internal dimple created following completion of the tube body in the form of a wall projecting forward into the tube which is created from the outside. Internal dimples created from a punched tab in the wall of the tube are the most suitable, whereby the free end of the punched tab which is bent inward is pointing towards the wider end of the tube body, so preventing the bottom wall of a nested second tube from pressing the punched tab back onto the level of the tube casing. Where it is essential for openings to be avoided in the tube casing, the inner spacing means can be formed by projections in the wall which only create an indentation on the outside of the tube body.

The formation of the tube body as provided by the invention requires no modification of the tube body production process. Tube bodies are wound, for example, in the conventional way from paper webs with a smooth inner surface, or with a smooth inner surface made of cellulose pulp. Only after their completion are the tube bodies provided with the described internal dimple using simple devices which do not necessitate interruption of the continuous production process. In the case of tube bodies formed from fibre stock, the dimples can be made while in a semi-dried state, so permitting the tube body to stiffen during the remaining drying process.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
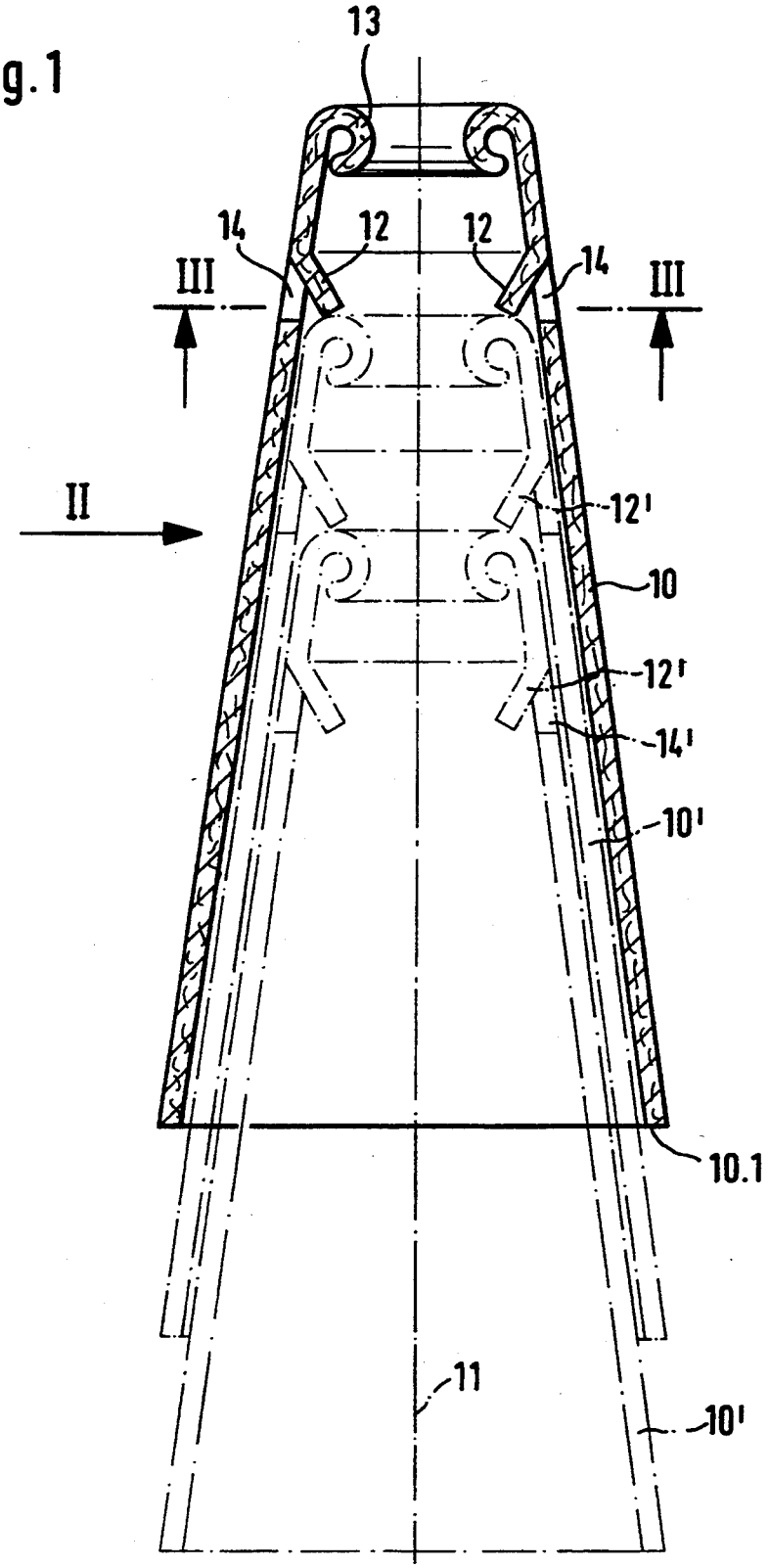
FIG. 1 demonstrates a schematic central longitudinal section of three nested tube bodies.

FIG. 1 shows a central longitudinal section of a conical hollow tube body 10, in which a second and third identical tube body 10', drawn with shaded lines, have been nested along the longitudinal axis 11 of the tube body. In the indicated execution example, two internal dimples 12 are formed in the narrowed end area of the tube body 10. The tube bodies 10, 10' are formed of several layers of paper.

The wound tube bodies 10 and 10' are provided at their narrow end with a beading 13. The internal dimples 12, 12' are formed following completion of the tube bodies 10, 10' by a punched tab pushed towards the inside, at the same time forming punched openings 14, 14' in tube bodies 10, 10'. The punched cuts in the tube body are formed in such a way that the punched tabs pushed towards the inside which form the internal dimples 12, 12' are directed towards the unbeaded wider end 10.1.

Figure 1A:
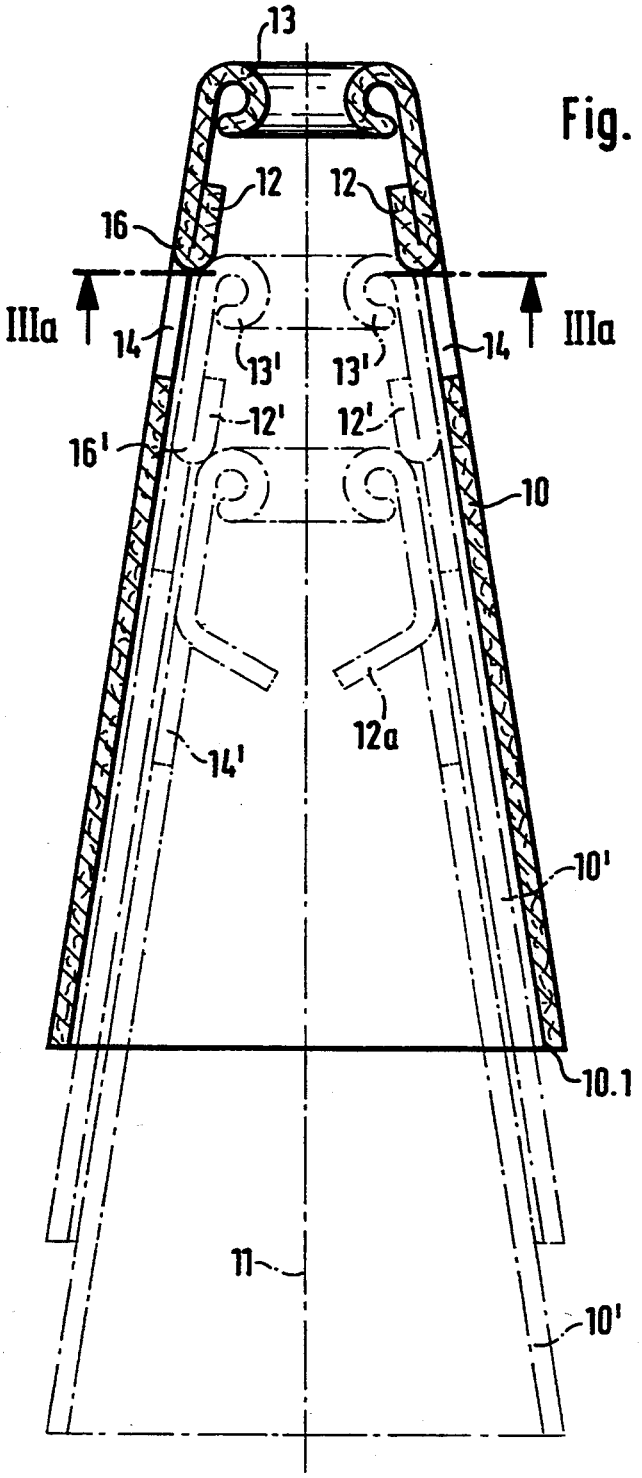
FIG. 1*a* shows the same arrangement as FIG. 1 with altered tube bodies.
Figure 3A:
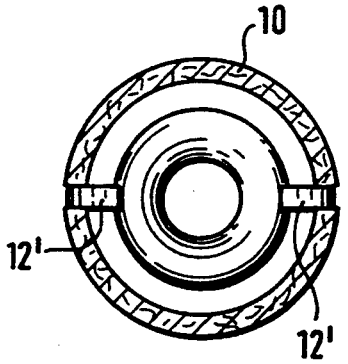
FIG. 3*a* shows a cross section along line III*a*—III*a* in FIG. 1*a;*
Figure 2:
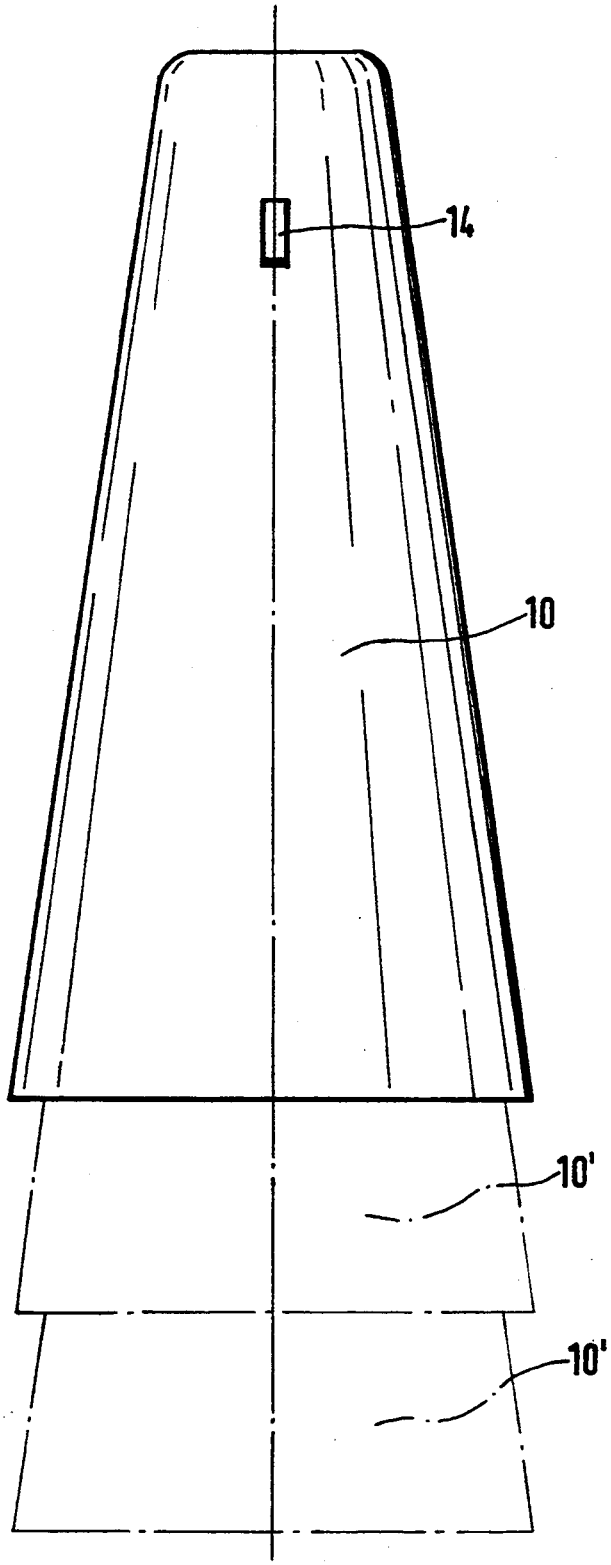
FIG. 2 shows a side view of the stack of tubes in the direction of arrow II indicated in FIG. 1.
Figure 3:
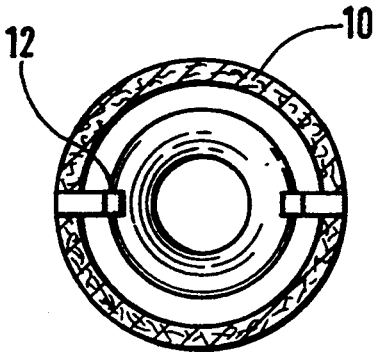
FIG. 3 shows a cross section along line III—III as indicated in FIG. 1.

In the execution examples demonstrated by FIGS. 1*a* and 3*a*, the punched tabs 12, 12', 12*a* which form the spacing means are bent inwards into a transverse position (in the case of tab 12*a*) or until they make contact with the inside of the tube body 10, 10 (punched tabs 12, 12') so that they can certainly not be pushed back again into the punched holes 14, 14'.

Figure 4:
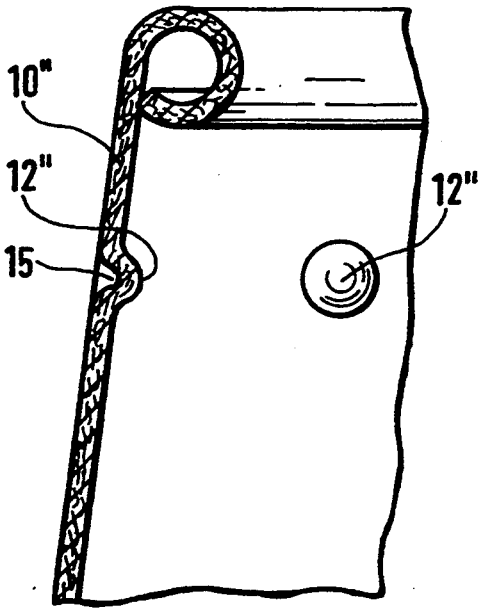
FIG. 4 demonstrates a partial cross-section through the upper area of a tube body with a different type of interior spacing means.

In the tube body 10'' indicated in FIG. 4, the internal dimples 12'' are formed by embossing in the wall carried out after completion of the tube body, which creates corresponding indentations 15 on the outside of the tube body 10''. In tube body 10'', no through-holes 14 are therefore created. In this case, it is expedient to form several internal dimples 12'' distributed around the periphery of the tube body 10''.

When the tube bodies 10, 10', 10'' are formed in accordance with the present invention no modification of the production process is needed. The tube bodies are wound in a conventional way from for example paper webs with a smooth inner surface, or a smooth inner surface made of cellulose pulp. Only after their completion the tube bodies 10, 10', 10'' are provided with the internal dimples 12, 12', 12'' using simple devices which do not necessitate interruption of the continuous production process. In the case of tube bodies formed from fiber stock, the dimples can be made while in a semi-dried state, so permitting the tube body to stiffen during the remaining drying process.

It will be understood that each of the elements described above, or two or more together, may also find a useful application in other types of methods and constructions differing from the types described above.

While the invention has been illustrated and described as embodied in a conical stacking body and method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A conical hollow stacking tube body capable of maintaining a gap between a plurality of stacked tube bodies comprising a narrow end and a wide end; and a spacing means for preventing wedging of the stacking tube body in a tube stack formed as at least one tab by punching from the outside inwardly in a wall of said body in an area of said narrow end and having a free end which is bent inwardly and directed toward said wide end of said body, said wall of said body having a throughgoing opening adjacent said tab after punching of said wall to form said tab.

2. A conical hollow tube body as defined in claim 1, wherein said punched tab is bent inwardly so that it extends transverse to an axis of said body.

3. A conical hollow tube body as defined in claim 1, wherein said punched tab is bent inwardly and round so that it makes contact with an inner surface of said wall of said body.

4. A conical hollow tube body as defined in claim 1, wherein said body is composed of several layers of paper.

5. A conical hollow tube body as defined in claim 1, wherein said body is composed of a dried fiber stock.

6. A method of producing a conical hollow stacking tube body capable of maintaining a gap between a plurality of stacked tube bodies, comprising the steps of forming a conical hollow stacking tube body having a narrow end and a wide end; and producing a spacing means for preventing wedging of the tube body in a tube stack by punching an area of said narrow end of a wall of said body from the outside inwardly so as to form at least one tab with a free end which is bent inwardly and directed toward said wide end of said tube body, said punching including forming a throughgoing opening adjacent to said tab.

7. A method as defined in claim 6, wherein said punching includes bending the tab inwards until it assumes a position transverse to an axis of the body.

8. A method as defined in claim 6, wherein said punching includes bending the tab inwards and round until it makes contact with an inner surface of the wall of the body.

9. A method as defined in claim 6, wherein said forming includes forming the body of paper with several layers.

10. A method as defined in claim 6, wherein said forming includes forming the body from a moist fiber stack, and subsequently drying the fiber stack.

* * * * *

UNITED STATES PATENT AND TRADEMARK OFFICE

CERTIFICATE OF CORRECTION

PATENT NO. : 5,403,633

DATED : April 4, 1995

INVENTOR(S) : Michael Jenisch

It is certified that error appears in the above-indentified patent and that said Letters Patent is hereby corrected as shown below:

Title page, item [73], Assignee: should read-- CHRISTIAN MAJER GMBH & Co. KG.--.

Signed and Sealed this

Eleventh Day of July, 1995

*Attest:*

*Attesting Officer*

BRUCE LEHMAN

*Commissioner of Patents and Trademarks*